US005756031A

United States Patent [19]

Tani et al.

[11] Patent Number: 5,756,031

[45] Date of Patent: May 26, 1998

[54] PROCESS FOR PREPARING POLYBENZAZOLE FILAMENTS AND FIBER

[75] Inventors: Katsuya Tani, Shiga; Ihachiro Iba, Ohtsu, both of Japan; Timothy L. Faley; Michael E. Mills, both of Midland, Mich.; Ira M. Thumma, Shepherd, Mich.

[73] Assignee: Toyobo Co., Ltd., Osaka, Japan

[21] Appl. No.: 793,038

[22] PCT Filed: Aug. 10, 1995

[86] PCT No.: PCT/US95/10271

§ 371 Date: Jan. 30, 1997

§ 102(e) Date: Jan. 30, 1997

[87] PCT Pub. No.: WO96/05341

PCT Pub. Date: Feb. 22, 1996

[30] Foreign Application Priority Data

Aug. 12, 1994 [JP] Japan ..... 6-190635

[51] Int. Cl.[6] ..... D01D 5/04; D01D 5/06; D01F 6/26; D01F 6/74

[52] U.S. Cl. ..... 264/203; 264/205; 264/211.15; 264/211.16; 264/211.17; 264/233; 264/234

[58] Field of Search ..... 264/103, 184, 264/203, 205, 211.15, 211.16, 211.17, 233, 234

[56] References Cited

U.S. PATENT DOCUMENTS

| | | | |
|---|---|---|---|
| 5,164,131 | 11/1992 | Chau et al. | 264/28 |
| 5,288,445 | 2/1994 | Tani et al. | 264/85 |
| 5,288,452 | 2/1994 | Yabuki | 264/345 |
| 5,294,390 | 3/1994 | Rosenberg et al. | 264/103 |
| 5,296,185 | 3/1994 | Chau et al. | 264/205 |
| 5,356,584 | 10/1994 | Bubeck et al. | 264/205 |
| 5,385,702 | 1/1995 | Mills et al. | 264/103 |
| 5,393,478 | 2/1995 | Sen et al. | 264/203 |
| 5,411,694 | 5/1995 | Alexander et al. | 264/184 |
| 5,417,915 | 5/1995 | Chau et al. | 264/344 |
| 5,429,787 | 7/1995 | Im et al. | 264/344 |
| 5,525,638 | 6/1996 | Sen et al. | 521/61 |
| 5,534,205 | 7/1996 | Faley et al. | 264/103 |
| 5,552,221 | 9/1996 | So et al. | 428/373 |
| 5,585,052 | 12/1996 | Chau et al. | 264/28 |

FOREIGN PATENT DOCUMENTS

WO 94/12700 6/1994 WIPO .

*Primary Examiner*—Leo B. Tentoni
*Attorney, Agent, or Firm*—Morrison & Foerster LLP

[57] ABSTRACT

A process for the preparation of polybenzazole filaments which comprises (a) extruding a solution of polybenzazole polymer in a mineral acid through a spinneret having at least 100 holes, which are arranged to form a annular pattern around the center of the spinneret, the center and at least two radial sections of the spinneret having no holes and an average width which is at least about 3 times the minimum pitch of the holes, thereby forming filaments of the polymer solution; (b) drawing the filaments of the polymer solution through a quench chamber while providing a substantially radial gas flow therein across the spinneret from at least two different directions; and (c) washing and drying the filaments of the polymer solution under conditions sufficient to form polybenzazole filaments.

11 Claims, 2 Drawing Sheets

PROCESS FOR PREPARING POLYBENZAZOLE FILAMENTS AND FIBER

BACKGROUND OF THE INVENTION

The present invention relates to a process for the preparation of polybenzoxazole or polybenzothiazole filaments and fibers.

Fibers prepared from polybenzoxazole (PBO) and polybenzothiazole (PBT) (hereinafter referred to as PBZ or polybenzazole polymers) may be prepared by first extruding a solution of polybenzazole polymer in a mineral acid (a polymer "dope") through a die or spinneret to prepare a dope filament. The dope filament is then drawn across an air gap, washed in a bath comprising water or a mixture of water and a mineral acid, and then dried. If multiple filaments are extruded simultaneously, they may then be combined into a multifilament fiber before, during, or after the washing step.

As the filaments of polybenzazole dope are extruded, the high extensional viscosity of the dope, the rapid cooling of the filaments, and the differences in the cooling rates of the filaments extruded at the center of the spinneret as compared to those extruded at the edge of the spinneret, may cause frequent breaks in the filaments as they are drawn across the air gap. Although this spinning stability problem can be reduced to some extent by using a slower spinning speed, and/or having a lower hole density on the spinneret, these methods are often less than desirable from the standpoint of productivity or equipment design. Since smaller diameter filaments are more desirable than larger diameter filaments which would be normally obtained by the use of a spinneret having larger orifices, the spin-draw ratio may need to be increased significantly to draw the filaments sufficiently to produce smaller diameter filaments, which may also cause breaks in the filaments.

Further, although the stability of the spinning line may be improved by decreasing the number of holes per spinneret (referred to hereafter as hole density), it becomes necessary to increase the number of spinnerets per spinning head or to increase the spinneret size in order to continuously spin a large number of filaments from a single spinning head. However, such equipment configurations may be less than desirable.

U.S. Pat. Nos. 5,294,390 and 5,385,702 disclose processes for increasing the stability of a spinning line by extruding polybenzazole filaments through a partially enclosed air gap which has gas flowing through it to cool the filaments at a relatively uniform temperature. Although this method increases the stability of the spinning line, methods for further increasing the spinning stability and the number of filaments which can be extruded per spin head while maintaining a relatively stable spinning line are desirable.

SUMMARY OF THE INVENTION

In one aspect, this invention is a process for the preparation of polybenzazole filaments which comprises (a) extruding the filaments from a spinneret having at least 100 holes, which are arranged to form a annular pattern around the center of the spinneret, the center and at least two radial sections of the spinneret having no holes and an average width which is at least about 3 times the minimum pitch of the holes; and (b) drawing the filaments through a quench chamber while providing a substantially radial gas flow therein across the spinneret from at least two different directions.

In a second aspect, this invention is a process for the preparation of polybenzazole filaments which comprises (a) extruding the filaments from a spinneret having at least 100 holes, which are arranged to form an annular pattern around the center of the spinneret, the center having no holes and an average width which is at least about 3 times the minimum pitch of the holes; and (b) drawing the filaments through a quench chamber while providing a substantially radial gas flow therein through the filaments from at least two directions.

It has been discovered that the process of the invention provides a means to prepare polybenzazole filaments and fibers which permits their spinning from spin-dies having a relatively high orifice density, but while maintaining relatively stable spinning conditions. The stability of the spinning conditions creates a more efficient spinning process by minimizing the number of line breaks, insures the uniformity of the filament being drawn, which allows one to optimize the cooling conditions of the filaments, which may improve the tensile strength and tensile modulus of the filaments. The air flow penetrability between filaments immediately under the spinneret is improved, the cooling of the strands and the thinning profile becomes more uniform, and the spinning process is stabilized by use of the process of the invention. These and other advantages will be apparent from the description which follows.

BRIEF DESCRIPTION OF THE FIGURES

Referring now to FIG. 1, a spinneret (1) is shown, which is part of a group of holes (2), three groups of which are separated from each other by radial sections of the spinneret (3) which do not have holes, having a width (W).

DETAILED DESCRIPTION OF THE PREFERRED EMBODIMENTS

Figure 1:
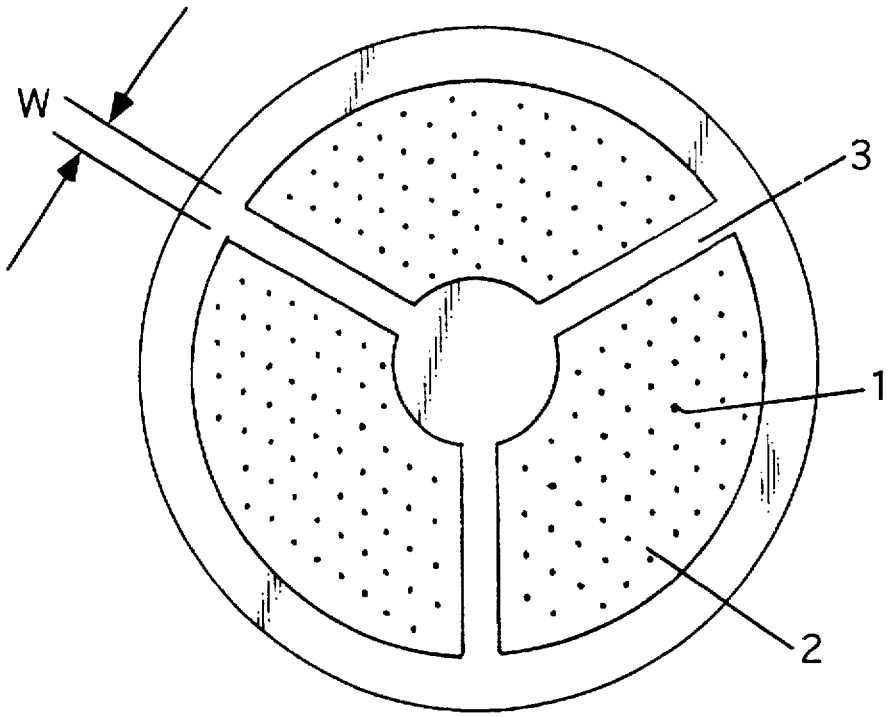
FIG. 1 shows an example of a spinneret hole pattern for use in the process of the first aspect of the invention, as described below.

The polybenzazole filaments used in the process of the invention may be obtained by spinning a dope containing a polybenzazole polymer. As used herein, "polybenzazole" refers to polybenzoxazole (PBO) homopolymers, polybenzothiazole (PBT) homopolymers, and random, sequential or block copolymerized polymer of PBO and PBT. Polybenzoxazole, polybenzothiazole, and random, sequential, or block copolymerized polymers thereof are described, for example, in "Liquid Crystalline Polymer Compositions, Process and Products," by Wolfe et. al, U.S. Pat. No. 4,703,103 (Oct. 27, 1987); "Liquid Crystalline Polymer Compositions, Process and Products," U.S. Pat. No. 4,533,692 (Aug. 6, 1985); "Liquid Crystalline Poly(2, 6-benzothiazole) Composition, Process and Products," U.S. Pat. No. 4,533,724 (Aug. 6, 1985); "Liquid Crystalline Polymer Compositions, Process and Products," U.S. Pat. No. 4,533,693 (Aug. 6, 1985); "Thermooxidatively Stable Articulated p-Benzobisoxazole and p-Benzobisthiazole Polymers" by Evers, U.S. Pat. No. 4,539,567 (Nov. 16, 1982); and "Method for Making Heterocyclic Block Copolymer" by Tsai, U.S. Pat. No. 4,578,432 (Mar. 25, 1986).

The structural units present in PBZ polymer are preferably selected so that the polymer is lyotropic liquid crystalline. Preferred monomer units are illustrated below in Formulas I–VIII. The polymer more preferably consists essentially of monomer units selected from those illustrated below, and most preferably consists essentially of cis-polybenzoxazole, trans-polybenzoxazole, or trans-polybenzothiazole.

I

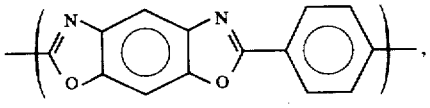

cis-polybenzoxazole
Poly[benzo(1,2-d:5,4-d')bisoxazole-2,6-diyl-1,4-phenylene]

II

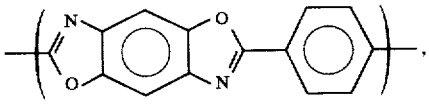

trans-polybenzoxazole
Poly[benzo(1,2-d:5,4-d')bisoxazole-2,6-diyl-1,4-phenylene]

III

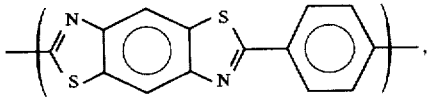

trans-polybenzothiazole

IV

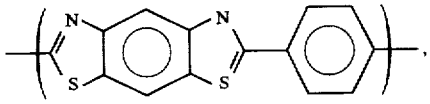

cis-polybenzothiazole

V

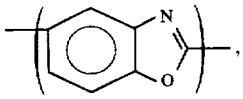

AP-PBO
Poly(2,5-benzoxazole)

VI

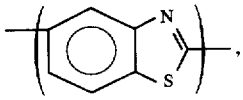

Poly(2,5-benzothiazole)

VII

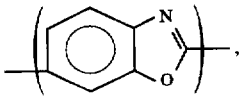

AB-PBO
Poly(2,6-benzoxazole)

and

VIII

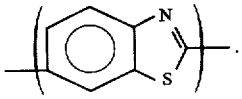

Poly(2,6-benzothiazole)

Suitable polybenzazole polymers or copolymers and dopes can be synthesized by known procedures, such as those described in Wolfe et al., U.S. Pat. No. 4,533,693 (Aug. 6, 1985); Sybert et al., U.S. Pat. No. 4,772,678 (Sep. 20, 1988); Harris, U.S. Pat. No. 4,847,350 (Jul. 11, 1989); and Gregory et al., U.S. Pat. No. 5,089,591 (Feb. 18, 1992). In summary, suitable monomers are reacted in a solution of nonoxidizing and dehydrating acid (the acid solvent) under nonoxidizing atmosphere with vigorous mixing and high shear at a temperature that is increased in stepwise or ramped fashion from no more than about 120° C. to at least about 190° C.. Suitable solvents for the preparation of PBZ polymer dope include cresols and non-oxidizing acids. Examples of suitable acid solvents include polyphosphoric acid, methane sulfonic acid, and highly concentrated sulfuric acid or mixtures thereof. Preferably, the solvent acid is polyphosphoric acid or methane sulfonic acid, but is most preferably polyphosphoric acid.

The polymer concentration in the solvent is preferably at least about 7 percent by weight, more preferably at least about 10 percent by weight, and most preferably at least about 14 percent by weight. The maximum concentration is limited by the practical factors of handling, such as polymer solubility and dope viscosity. The polymer concentration normally does not exceed 30 percent by weight, and is preferably no greater than about 20 percent by weight. Oxidation inhibitors, de-glossing agents, coloring agents, and anti-static agents may also be added to the dope.

These polybenzazoles are directly or separately spun by a dry-jet wet spinning method as spun dope dissolved in polyphosphoric acid. The polybenzazole dope is preferably filtered by being passed through a porous plate having a number of holes with a diameter of 1 to 5 mm. Next, it preferably passes through a space called a melt pool formed by the porous plate surface and the spinning nozzle back surface, and through a woven material or unwoven fabric of metal fibers contained therein. The dope is then spun through a spinneret having a number of holes arranged in a circular, lattice or clover shape. The arrangement of the spinning holes on the spinneret and the hole density will affect the ability of the gas to flow past the filaments closer to the source of the gas and reach the filaments further away.

FIG. 1 shows an example of a spinneret which may be used in the process of the first aspect of the invention. As shown in this figure, the holes of the spinning nozzle are divided into groups which are separated from each other by sections of the spinneret which have no spinning holes. The hole density on the spinneret in both processes of the invention is preferably at least above 2.0 holes/cm$^2$, more preferably least about 4.0 holes/cm$^2$, and most preferably at least about 6.0 holes/cm$^2$, but is preferably less than about 10.0 holes/cm$^2$, (based on the spinneret area covered by the holes, which is also referred to herein as the "active" area). In general, higher hole densities are preferred from a productivity standpoint, although as the hole density increases, it becomes more difficult to conduct the cooling gas through the filaments being extruded, in a manner sufficient to cool them at a uniform rate.

In the process of the first aspect of the invention, the spinneret is constructed such that the holes are divided into at least two groups, more preferably at least three groups. The number of groups is preferably less than ten, since the space on the spinneret required for the sections which have no holes will reduce the space available on the spinneret for holes. The patterns of the divided spinning hole groups are not especially limited but are preferably radially symmetric with respect to the center of the spinneret. Preferably, the width of the radial section(s) and the center section of the spinneret having no holes in the processes of both aspects of the invention is at least about 5 mm and less than about 50 mm, more preferably less than about 10 mm; or is preferably at least about 3 times the minimum pitch of the holes, and less than about 30 times the minimum pitch of the holes.

Figure 2:
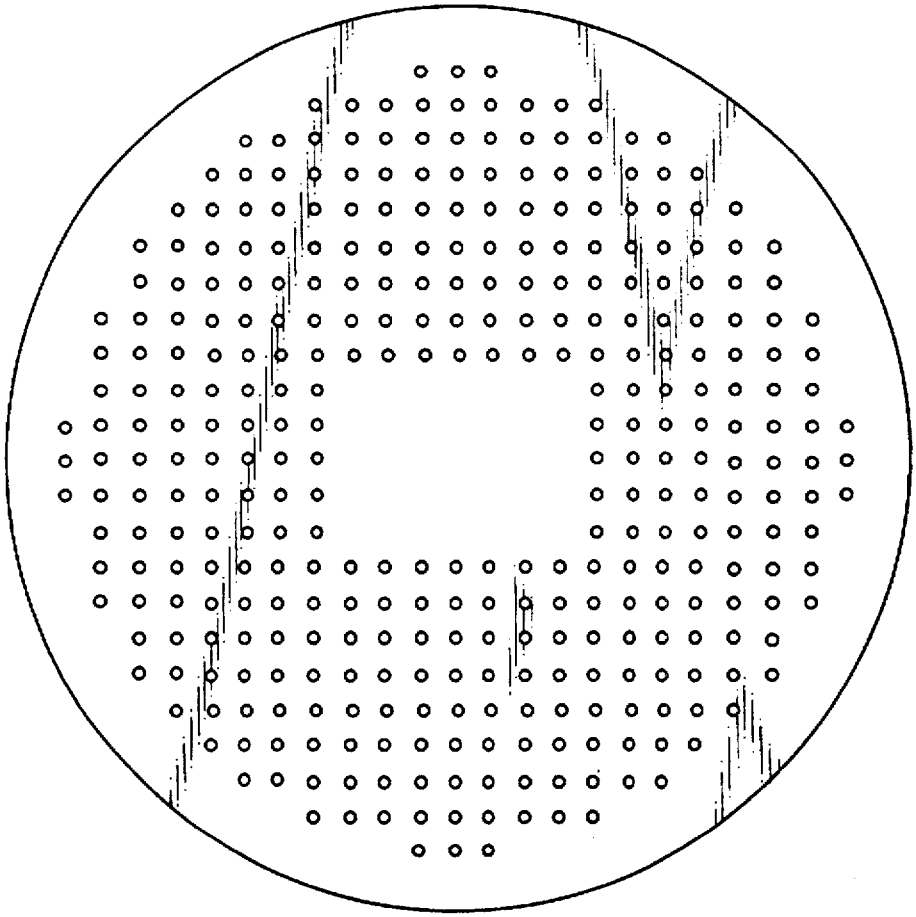
FIG. 2 shows an example of a spinneret hole pattern useful in the process of the second aspect of the invention.

FIG. 2 shows a spinneret which is useful in the process of the second aspect of the invention. In the second aspect of the invention, there is a space in the middle of the spinneret having no holes, and the holes need not be divided into sections. One advantage of this aspect of the invention is that once the spinning conditions are optimized for a given radial width of filaments (the distance between the outside of the active area to the inside of the active area, defined in part by the width of the space in the middle of the spinneret) at a given pitch distance, different size spinnerets having a different number of holes may be designed and utilized under substantially the same spinning conditions, so long as the holes in the spinneret are configured to maintain the same radial width. The term "annular pattern" as used herein means that the spinning holes are arranged on the spinneret to leave a space in the center of the arrangement which has no holes. FIG. 2 illustrates an annular lattice pattern.

The dope filaments extruded through the spinneret are cooled to a temperature less than the solidifying temperature of the dope by passing them through an air gap, and into a washing bath containing a suitable washing fluid. Initially, as the filaments are extruded from the spinneret, they preferably pass through a quench chamber which surrounds the filaments as they leave the spinneret. While the quench chamber length is optional, it is preferably long enough to provide a relatively constant temperature atmosphere upon initial extrusion from the spinneret such as with a flow of inert gas across the filaments to maintain a temperature from 0° C. to 100° C. in the quench chamber. Once the filament leaves the quench chamber, it can be exposed to atmospheric conditions until it is coagulated. The length of the quench chamber is preferably between about 2 and 120 cm, but may be longer.

The gas flow across the filaments is directed from at least two different directions. Preferably, a number of gas jets are used to direct the gas flow across radial portions of the filaments from as many directions as is practical. Alternatively, a series of baffles inside the quench chamber may be used to help direct gas flow therein, or a pressurized device surrounding the filaments having a screen or filter which permits an evenly distributed gas flow through the radial sections of filaments may also be utilized. The gas may originate either from outside the arrangement of filaments, or from a source located in the middle of the arrangement. It is believed, without intending to be bound, that a radial quench of the filaments by a gas coming from a number of directions around the filaments is highly desirable in terms of cooling all of the filaments at a uniform rate, permitting the cooling temperature to be more easily optimized for all of the filaments, and increasing the stability of the spinning line. As the gas travels across a radial portion of the arrangement of filaments, it is continuously drawn downwards between the filaments. The temperature of the gas is preferably at least about 30° C., more preferably at least about 40° C., and most preferably at least about 50° C., but is preferably no greater than about 100° C., more preferably no greater than about 90° C., and most preferably no greater than about 80° C.

A convenient means of washing the filaments as an initial washing step in a multi-step washing process is to run the filaments through a funnel-shaped solidifying bath, a multi-step water aspirator, or other vertical bath. Thereafter, the filaments may be further washed in a bath utilizing wash rolls. After the filaments are passed through the first washing bath, they travel over at least one driven roller. The maximum spin/draw ratio in the air gap which will allow continuous stable spinning decreases as the filament deniers become thinner. Stable spinning of 1.5 denier filaments at a speed greater than 200 m/minutes is possible by the method of this invention. The average denier per filament (dpf) is preferably at least about 1.5, and less than about 3.5.

The filaments are subsequently washed under conditions sufficient to preferably remove at least about 98.0 weight percent of the solvent acid present in the filaments, more preferably at least about 99 weight percent, and most preferably at least about 99.5 weight percent. Suitable washing fluids include any liquid which is a non-solvent for the polymer, but which will dilute the acid solvent in the dope filament. Examples of washing fluids include water, methanol, acetone, and mixtures of water and the solvent of which the polybenzazole dope is comprised, either in liquid or vapor form. Preferably, the dope is prepared utilizing polyphosphoric acid and the washing fluid is a mixture of water and polyphosphoric acid. Furthermore, the washing of the filaments may be carried out as a multi-step process.

The washed filaments may be subsequently dried in a suitable drying process. Furthermore, it may also be desirable to apply a spin finish to the filaments before or after being dried, in order to help protect the filaments from mechanical damage. To increase the tensile modulus of the filament, they may be heat-treated at a temperature greater than 300° C. or more preferably at a temperature greater than 450° C., but is preferably less than 650° C.

The process of the invention is preferably carried out at a terminal velocity of at least about 200 m/minute, more preferably at least about 400 m/min, and most preferably at least about 600 m/min.

The filament utilized in the process of the invention may be combined with other filaments to form a multifilament fiber at any point during the process of the invention. Preferably, however, the filaments are combined just prior to, or during, the first washing bath. In addition, when a large number of filaments are spun simultaneously, the filaments can be divided into several groups by a guide after the initial washing step, as a means to prepare more than one multifilament fiber from the same spinneret.

The tensile strength of the filaments produced by the process of the invention is preferably at least about 600 Ksi (600,000 psi), and is more preferably at least about 800 Ksi. The tensile modulus of the filaments produced by the process of the invention is preferably at least about 20 Msi ($30\times10^6$ psi), more preferably at least about 30 Msi.

EXAMPLES

The following examples are given to illustrate the invention and should not be interpreted as limiting it in any way. The following methods for measuring the physical properties of the filaments and fibers and the spinning stability were used to obtain the data reported in Table I.

Method for measuring the intrinsic viscosity

The reduced viscosity at 30° C. was obtained by dissolving polybenzazole into methane sulfonic acid at various concentrations and then extrapolating to zero concentration.

Monofilament denier

A sample of fiber was maintained at a temperature of 20±2° C. and a relative humidity of 65±2 percent for 18 hours, a 90 m portion of the sample was taken, its weight was measured, and the measured weight was converted into a weight of 9000 m to obtain the fiber denier. The monofilament denier was calculated from the fiber bundle denier by dividing by the number of monofilaments in the bundle.

Method for determining the Maximum spin/draw ratio

The fiber strand was taken by a pulling roller (group) without contacting it with a washing fluid, the said roller circumferential speed was increased by a certain rate of increase, and the maximum spin/draw ratio was defined as the ratio of the maximum spinning speed at which fiber breaking occured (Vw) to the ejection line speed within a hole (Vo) obtained from a single hole ejection amount and the hole diameter, or Vw/Vo.

Method for evaluating the spinning stability

Spinning was performed at a speed of 200 m/minute, until a statistically significant rate of fiber breakage was obtained, which was then converted to represent the number of breaks over an 8 hour period.

Method for measuring fuzz (filament breakage)

A wound roll of washed and dried fiber was unwound at a rate of 100 m/minute, and the fuzz was counted by a photoelectric tube type fuzz detector until a statistically significant number was obtained, which was then converted into a rate of filament breakage per 10,000 m.

Method for measuring the Tensile Strength, Tensile Modulus, and Elongation at Break The averages of the tensile strength, tensile modulus, and elongation at break were obtained from measurements at a grip interval of 5 cm, a stretching speed of 100 percent per minute and n=30 using a Tensilon™ machine from Orientech (Inc.) Company, in accordance with Test Method No. JIS L 1013 (1981).

Example 1

A portion of 4,6-diamino-1,3 benzene diol.dihydrochloride (50.0 g, 0.235 mol) was stirred with 200 g polyphosphoric acid (with phosphorus pentoxide content of 83.3 weight percent) under a nitrogen gas flow at 40° C. for 12 hours. The temperature of the mixture was raised to 60° C. and hydrochloric acid was removed under a reduced pressure of about 50 mm Hg. Terephthalic acid (39.0 g, 0.236 mol) and phosphorus pentoxide (103 g) were added to the above and the mixture was polymerized under a nitrogen gas flow at 60° C. for 8 hours and at 120° C. for 9 hours, at 150° C. for 15 hours, and at 180° C. for 24 hours. Polybenzazole polymer solution obtained thus was used as dope for spinning. The intrinsic viscosity of the polymer was obtained by mixing a sample of the solution with water in a blender to obtain a washed sample of the polymer particles. The polymer particles were redissolved in methane sulfonic acid, the viscosity was measured at 215° C. and the intrinsic viscosity [η] was 30.5 dl/g.

The polymer concentration of the dope was 14.0 weight percent, and the concentration of the solvent of the case of using phosphorus pentoxide as polyphosphoric composition was 86.0 weight percent. After kneading the dope using a twin-screw extruder and degassing the dope, it was transferred to the spinning head via a gear pump. It was passed through a particle filler layer of a layer width of 50 mm (with varied average particle diameter and average aspect ratio) composed of inorganic substances at the spinning head, passed through a dispersing plate with a multiple number of holes of a diameter of 2 mm punctured in a frame form, and then passed through a laminate layer of a rate of permeation of particles of above 15 mm of 2.5 percent, constructed from a metal fiber fabric of a diameter of 10 mm.

The dope was spun at a temperature of 160° C. and an ejection rate of 64.2 g/minute by being passed through a spinneret having a hole density of 4.8 holes/cm$^2$ with 284 fine holes of a hole diameter of 0.20 mm, a hole length of 0.20 m, and an entrance angle of 20 degrees, divided into groups by a section width (W) of 8.6 mm as shown in FIG. 1. The number of orifice holes was preferably at least about 500, more preferably at least about 1,000, and most preferably at least about 2,500.

The spun filaments were then guided through a quench chamber providing an air flow through the filaments from at least two directions into a funnel-shaped coagulating apparatus circulating a 20 percent aqueous solution of polyphosphoric acid maintained at a temperature of 22°+2° C., installed 35 cm below the spinning nozzle surface. Furthermore, extraction and washing of phosphoric acid in the fiber strand were performed by rolling the spun fiber on a roller (group) installed at the lower outside of the said extraction bath to change the running direction of the fiber strand, releasing the spinning tension by rolling the fiber strand on a roller (group), while spraying water on the running fiber strand by a spraying apparatus installed near the said roller. The fiber was then passed through a hot air circulatory dryer to decrease its water content to less than 2.0 weight percent, and then wound at a speed of 200 m/minutes. The results are shown below in Table I.

Examples 2–11

Fibers were prepared using the method described in Example 1, with following exceptions: For Examples 2 and 3, the diameter of the holes in the spinneret was 0.20 mm, the hole length was 0.20 mm, the entrance angle to the spinning holes is 20° C., and the hole density was 3.4 and 4.0 holes/cm$^2$, respectively, for each example. For examples 4 and 5, the width of the sections divided into groups of spinning holes (W) was changed to 6.5 mm (Example 4), and 9.9 mm (Example 5). In Examples 6–8, the spinnerets have 2, 6, and 8 groups of spinning holes, respectively. In Examples 9–11, the single hole ejection amount was 0.69 g/minute, and the ejected dope filament was cooled at the air gap area by applying a gas flow at an average flow speed of 0.7 m/second at a temperature of 55° C. to 95° C. The results are shown in Tables I and II.

TABLE I

| Experiment # | | Example 1 | Example 2 | Example 3 | Example 4 | Example 5 |
|---|---|---|---|---|---|---|
| Number of Orifice Groups | — | 3 | 3 | 3 | 3 | 3 |
| Width of Dividing Zone | mm | 8.6 | 8.6 | 8.6 | 6.5 | 9.9 |
| Effective Diameter of Spinneret | mm | 95 | 95 | 95 | 95 | 95 |
| Density of Orifices | /cm$^2$2 | 4.8 | 3.4 | 4.0 | 4.6 | 4.9 |
| Number of Orifices | — | 284 | 200 | 234 | 284 | 284 |
| Through-put per Orifice | g/min | 0.23 | 0.23 | 0.23 | 0.23 | 0.23 |
| Max. Spinning Speed | m/min | 246 | 246 | 246 | 247 | 246 |
| Spin Draw Ratio at Max. Spinning Speed | — | 67 | 67 | 67 | 67 | 67 |
| Denier per Filament at Max. Spinning Speed | — | 1.16 | 1.16 | 1.16 | 1.15 | 1.16 |
| Number of Fiber breaks at Max. Spinning Speed/8 Hours | | 1 | 0 | 1 | 0 | 2 |
| Fuzz at Max. Spinning Speed | /10000 m | 1.3 | 0.8 | 1.3 | 1.1 | 1.1 |
| Fiber Denier | den | 403 | 284 | 332 | 403 | 403 |
| Denier per Filament | — | 1.42 | 1.42 | 1.42 | 1.42 | 1.42 |

TABLE I-continued

| Experiment # | | Example 1 | Example 2 | Example 3 | Example 4 | Example 5 |
|---|---|---|---|---|---|---|
| Tensile Strength | GPa | 6.2 | 6.1 | 6.3 | 6.2 | 6.1 |
| Elongation at Break | % | 3.6 | 3.6 | 3.6 | 3.6 | 3.6 |
| Tensile Modulus | GPa | 217 | 215 | 219 | 214 | 212 |

TABLE II

| Experiment # | | Example 6 | Example 7 | Example 8 | Example 9 | Example 10 | Example 11 |
|---|---|---|---|---|---|---|---|
| Number of Orifice Groups | — | 2 | 6 | 8 | 3 | 3 | 3 |
| Width of Dividing Zone | mm | 8.6 | 8.6 | 8.6 | 8.6 | 8.6 | 8.6 |
| Effective Diameter of Spinneret | mm | 95 | 106 | 112 | 95 | 95 | 95 |
| Density of Orifices | /cm$^2$ | 4.5 | 4.5 | 4.5 | 4.8 | 4.8 | 4.8 |
| Number of Orifices | — | 284 | 284 | 284 | 284 | 284 | 284 |
| Through-put per Orifice | g/min | 0.23 | 0.23 | 0.23 | 0.68 | 0.68 | 0.68 |
| Max. Spinning Speed | m/min | 246 | 245 | 246 | 731 | 738 | 730 |
| Spin Draw Ratio at Max. Spinning Speed | — | 67 | 66 | 67 | 66 | 67 | 66 |
| Denier per Filament at Max. Spinning Speed | — | 1.16 | 1.16 | 1.16 | 1.17 | 1.16 | 1.17 |
| Number of Fiber Breaks at Max. Spinning Speed/8 hours | | 1.1 | 1.2 | 2.5 | 1 | 0 | 1 |
| Fuzz at Max. Spinning Speed | /10000 m | 1.7 | 1.8 | 3.8 | 1.3 | 1.0 | 1.2 |
| Fiber Denier | den | 403 | 403 | 403 | 403 | 403 | 403 |
| Denier per Filament | — | 1.42 | 1.42 | 1.42 | 1.42 | 1.42 | 1.42 |
| Tensile Strength | GPa | 6.2 | 6.2 | 6.0 | 6.2 | 6.2 | 6.1 |
| Elongation at Break | % | 3.6 | 3.6 | 3.6 | 3.6 | 3.7 | 3.6 |
| Tensile Modulus | GPa | 217 | 214 | 212 | 219 | 220 | 215 |

What is claimed is:

1. A process for the preparation of polybenzazole filaments which comprises (a) extruding a solution of polybenzazole polymer in a mineral acid through a spinneret having at least 100 holes, which are arranged to form an annular pattern around the center of the spinneret, the center and at least two radial sections of the spinneret having no holes and an average width which is at least about 3 times the minimum pitch of the holes, thereby forming filaments of the polymer solution; (b) drawing the filaments of the polymer solution through a quench chamber while providing a substantially radial gas flow therein across the spinneret from at least two different directions; and (c) washing and drying the filaments of the polymer solution under conditions sufficient to form polybenzazole filaments.

2. The process of claim 1 wherein the spinneret has at least 500 holes.

3. The process of claim 1 wherein the spinneret has at least 1,000 holes.

4. The process of claim 1 wherein the spinneret hole density is at least about 4.0 holes/cm$^2$.

5. The process of claim 1 wherein the spinneret hole density is at least about 6.0 holes/cm$^2$.

6. A process for the preparation of polybenzazole filaments which comprises (a) extruding a solution of polybenzazole polymer in a mineral acid through a spinneret having at least 100 holes, which are arranged to form an annular pattern around the center of the spinneret, the center having no holes and an average width which is at least about 3 times the minimum pitch of the holes, thereby forming filaments of the polymer solution; (b) drawing the filaments of the polymer solution through a quench chamber while providing a substantially radial gas flow therein through the filaments from at least two directions; and (c) washing and drying the filaments of the polymer solution under conditions sufficient to form polybenzazole filaments.

7. The process of claim 6 wherein the spinneret has at least 500 holes.

8. The process of claim 6 wherein the spinneret has at least 1,000 holes.

9. The process of claim 6 wherein the hole density is at least about 4.0 holes/cm$^2$.

10. The process of claim 6 wherein the hole density is at least about 6.0 holes/cm$^2$.

11. A process for the preparation of polybenzazole filaments which comprises (a) extruding a solution of polybenzazole polymer in a mineral acid through a spinneret having at least 100 holes, which are arranged to form an annular pattern around the center of the spinneret, the center and at least two radial sections of the spinneret having no holes and an average width which is at least about 3 times the minimum pitch of the holes; and (b) washing and drying the filaments of the polymer solution under conditions sufficient to form polybenzazole filaments.

* * * * *